US007409350B2

(12) United States Patent
Hsu

(10) Patent No.: US 7,409,350 B2
(45) Date of Patent: Aug. 5, 2008

(54) AUDIO PROCESSING METHOD FOR GENERATING AUDIO STREAM

(75) Inventor: Chien-Hua Hsu, Hsin-Chu (TW)

(73) Assignee: MediaTek, Inc., Hsin-Chu (TW)

( * ) Notice: Subject to any disclaimer, the term of this patent is extended or adjusted under 35 U.S.C. 154(b) by 942 days.

(21) Appl. No.: 10/745,606

(22) Filed: Dec. 29, 2003

(65) Prior Publication Data

US 2004/0143431 A1 Jul. 22, 2004

(30) Foreign Application Priority Data

Jan. 20, 2003 (TW) ..... 92101160 A

(51) Int. Cl.
*G10L 21/04* (2006.01)

(52) U.S. Cl. ..... 704/501; 704/502

(58) Field of Classification Search ..... 704/205, 704/207, 229, 230, 500–504
See application file for complete search history.

(56) References Cited

U.S. PATENT DOCUMENTS 5,963,596 A * 10/1999 Benbassat et al. ..... 375/243
6,349,284 B1 * 2/2002 Park et al. ..... 704/500
6,560,283 B1 * 5/2003 Fletcher ..... 375/240.1
6,680,972 B1 * 1/2004 Liljeryd et al. ..... 375/240
6,687,670 B2 * 2/2004 Sydanmaa et al. ..... 704/226
6,721,700 B1 * 4/2004 Yin ..... 704/219
6,725,192 B1 * 4/2004 Araki ..... 704/230
6,754,618 B1 * 6/2004 Konstantinides et al. . 704/200.1
6,842,735 B1 * 1/2005 Covell et al. ..... 704/503
6,904,540 B2 * 6/2005 McClellan et al. ..... 714/6
2001/0032086 A1 10/2001 Layeghi

FOREIGN PATENT DOCUMENTS

EP 0967593 B1 4/2002

OTHER PUBLICATIONS

Information technology—coding of moving pictures and associated audio for digital storage media at up to about 1.5 Mbit/s. part 3: Audio. Technical report, ISO/IEC, MPEG 11172-3, 1993, P98-P108.
Information technology—generic coding of moving pictures and associated audio information. Part 7: Advanced audio coding (AAC). Technical report, ISO/IEC MPEG 13818-7, 1997.
H. Oh, J.Kim, C. Song, Y. Park and D. Youn. Low power MPEG/audio encoders using simplified psychoacoustic model and fast bit allocation. IEEE transactions on vol. 47, pp. 613-621, 2001.
C. Liu, C. Chen, W. Lee and S. Lee. "A fast bit allocation method for MPEG layer III". Proc. of ICCE, pp. 22-23, 1999.
Alberto D. Duenas, Rafael Perez, Begona Rivas, Enrique Alexandre, Antonio S. Pena. "A robust and efficient implementation of MPEG-2/4 AAC Natural Audio Coders". In AES 112th Convention, 2002.

* cited by examiner

*Primary Examiner*—Michael N Opsasnick

(57) ABSTRACT

An audio processing method utilized to generate an audio stream. An audio frame includes N frequency subbands. An Ith frequency subband among the N frequency subbands includes M audio samples and has an Ith psychoacoustic masking value. First, an Ith offset of the Ith frequency subband is calculated. Then, the Ith psychoacoustic masking value and the Ith offset are inputted into a projection formula to generate an Ith projection value. According to the Ith projection value and a limit range, an Ith scale factor is determined. Subsequently, the M audio samples in the Ith frequency subband are adjusted according to the Ith scale factor.

22 Claims, 8 Drawing Sheets

AUDIO PROCESSING METHOD FOR GENERATING AUDIO STREAM

BACKGROUND OF THE INVENTION

1. Field of the Invention

The present invention relates to a method for determining quantization parameters, particularly a method for determining quantization parameters in a bit allocation process.

2. Description of the Related Art

Since Thomas Alva Edison invented the gramophone, music has been playing an important role in people's lives. Because of people's demand of music, engineers keep on researching and have advanced the method to record and reproduce audio signals from the preliminary analog system to the presently popular digital system. Nowadays, CD (compact disc) is a popular format for storing audio signals. However, as the Internet continues to gain more popularity, the traditional format of CD music recordings is gradually replaced by some other coding algorithm formats, such as MPEG-audio Layer-3 or AAC (Advanced Audio Coding), because CD format recording generally has much more data size.

There are three steps in the traditional analog to digital music transforming process—Sampling, Quantization and Pulse Code Modulation (PCM). Sampling means reading the signal level of the music at each equal time interval. Quantization means representing the amplitude of each read signal in a quantization degree with a limited numerical value. Pulse Code Modulation (PCM) means representing the quantized value with a binary number. Traditional music CDs employ the aforementioned PCM technique to record analog music in the digital format, but it demands huge storage space and communication bandwidth. For example, nowadays music CDs adopt the 16 bits quantization degree. Therefore, it needs about 10 MB storage space for the music recording per minute. Due to the limited data transmission bandwidth for digital TV, wireless communication and the Internet, some encoding techniques for higher compression ratio on music signals are invented and developed.

Referring to FIG. 1, FIG. 1 shows a functional block diagram of an audio encoding system 10 of the prior art. Encoders, such as the aforementioned MPEG-audio LAYER-3 or AAC, encode a PCM sample into an audio bitstream of MPEG-audio LAYER-3 or AAC in the audio encoding system 10 in FIG. 1. The traditional audio encoding system 10 comprises a Modified Discrete Cosine Transform module (MDCT module) 12, a psychoacoustic module 14, a quantization module 16, an encoding module 18, and a bitstream packing module 19.

The PCM samples are inputted to both the MDCT module 12 and the psychoacoustic module 14, and the samples are first analyzed by the psychoacoustic module 14 to generate a masking curve and a window message. The masking curve delineates the range of audio signals to be perceived by ordinary human ears. Ordinary human ears can perceive only audio signals that are higher above than the masking curve.

According to the window message transmitted from the psychoacoustic module 14, the MDCT module 12 performs a modified discrete cosine transformation on the PCM samples. The PCM samples are transformed to a plurality of MDCT samples, and then the MDCT samples are grouped, according to the characteristic of human acoustic perception, to form a plurality of frequency subbands with non-equivalent bandwidth; each frequency subband is associated with a masking threshold. The quantization module 16 cooperates with the encoding module 18, repeatedly performing a bit allocation process on every frequency subband; such procedure ensures every MDCT sample in the frequency subbands conforms to the coding distortion standard. For instance, by means of a limited available bit numbers, the final encoding distortion of every MDCT sample is made to be lower than the corresponding masking threshold determined by the psychoacoustic module 14. After the bit allocation procedure, the encoding module 18 performs Huffman encoding on all MDCT samples in that frequency subband. Further, the bitstream packing module 19 combines all encoded frequency subbands, and packs all frequency subbands with corresponding side information so as to generate an audio bitstream, The side information contains information related to the entire audio encoding process, for example, window message, stepsize factor, Huffman encoding information, etc.

Referring to FIG. 2, FIG. 2 shows the flow chart of a conventional audio encoding. The conventional audio encoding such as MPEG-audio LAYER-3 (MP3) or AAC includes the following steps:

STEP 200: Start.

STEP 202: Receive PCM samples. Then go to step 204 and step 206.

STEP 204: Analyze the PCM samples using the psychoacoustic module to determine the corresponding masking curve.

STEP 206: Perform the modified discrete cosine transformation on the PCM samples to generate a plurality of MDCT samples which are grouped into several frequency subbands; each frequency subband may include different number of MDCT samples.

STEP 208: According to the masking threshold of each corresponding frequency subband, perform a bit allocation process on every MDCT sample in the frequency subband, so that the MDCT samples in the frequency subband conform to the encoding distortion standard.

STEP 210: Pack all of the encoded frequency subbands with the corresponding side information so as to generate a corresponding audio bitstream of the PCM samples.

STEP 212: End.

The bit allocation procedure performed by the quantization module 16 and the encoding module 18 in FIG. 1 further include many complicated steps. Referring to FIG. 3, FIG. 3 shows a flow chart of a conventional bit allocation procedure. The conventional bit allocation procedure includes the following steps.

STEP 300: Start.

STEP 302: Perform quantization of all the frequency subbands nonlinearly (disproportionately) according to a stepsize factor corresponding to each audio frame.

STEP 304: Look up the Huffman Table to calculate the number of bits needed by every MDCT sample of corresponding frequency subband.

STEP 306: Determine if the number of needed bits is lower than the number of available bits. If YES, go to STEP 310. If NO, go to STEP 308.

STEP 308: Increase the stepsize factor, and go back to STEP 302.

STEP 310: De-quantize the quantized frequency subbands.

STEP 312: Calculate the distortion of the frequency subbands.

STEP 314: Store the scalefactor of the frequency subbands and the stepsize factor of the audio frame.

STEP 316: Determine if there is any frequency subband with distortion exceeds the corresponding masking threshold. If NO, go to STEP 322. If YES, go to STEP 317.

STEP 317: Determine if there is any other termination condition met (such as the scalefactor has reached the upper limit); if YES, then go to STEP 318, if NO, then go to STEP 320.

STEP 318: Increase the value of the scalefactor.

STEP 319: Amplify all the MDCT samples of the frequency subband according to the scalefactor, and then go to STEP 302.

STEP 320: Determine if the scalefactor and the stepsize factor are better values or the most preferable values. If YES, then go to STEP 322. If NO, then go to STEP 321.

STEP 321: Restore previous better scalefactor and stepsize factor; then go to STEP 322.

STEP 322: End.

From the discussion above, there are two loops in the bit allocation procedure for determining the quantization parameter. The first loop is from STEP 302 to STEP 308; it is usually called the inner loop or the bit rate control loop, used for determining the stepsize factor. The second loop is from STEP 302 to STEP 322; it is usually called the outer loop or the distortion control loop, used for determining the scalefactor. Thus, each run of the traditional bit allocation method usually requires many runs of the outer loop, and every outer loop includes many runs of the inner loop. Such replicated operation leads to poor efficiency of the prior art. To improve the encoding efficiency, reducing the number of the loops and operations becomes important. Besides, since the bit allocation loop of the prior art only increments one to the stepsize factor each time, it causes the increase of the repeated operation of the bit-rate control loop.

Some Related Information are Listed for Reference.

[1] Information technology—coding of moving pictures and associated audio for digital storage media at up to about 1.5 Mbit/s. part 3: Audio. Technical report, ISO/IEC, MPEG 11172-3, 1993.

[2] Information technology—generic coding of moving pictures and associated audio information. Part 3: Audio. Technical report, ISO/IEC MPEG 13818-3, 1998.

[3] Information technology—generic coding of moving pictures and associated audio information. Part 7: Advanced audio coding (AAC). Technical report, ISO/IEC MPEG 13818-7, 1997.

[4] Information technology—very low bitrate audio-visual coding. Part 3: Audio. Technical report, ISO/IEC MPEG 14496-3, 1998.

[5] US2001/0032086 A1, Fast convergence method for bit allocation stage of MPEG audio layer 3 encoders.

[6] EP 0967593 B1, Audio coding and quantization method.

[7] H. Oh, J. Kim, C. Song, Y. Park and D. Youn. "Low power MPEG/audio encoders using simplified psychoacoustic model and fast bit allocation. IEEE transactions on Vol. 47, pp. 613-621, 2001.

[8] C. Liu, C. Chen, W. Lee and S. Lee. "A fast bit allocation method for MPEG layer III". Proc. of ICCE, pp.22-23, 1999.

[9] Alberto D. Duenas, Rafael Perez, Begona Rivas, Enrique Alexandre, Antonio S. Pena. "A robust and efficient implementation of MPEG-2/4 AAC Natural Audio Coders". In AES 112th Convention, 2002.

SUMMARY OF THE INVENTION

One aspect of the present invention is to provide a bit allocation process, which can reduce the number of loops for determining the quantization parameter and can reduce the number of loop operations to solve the problem of the prior art. Another aspect of the present invention is to provide a bit allocation process, which can efficiently use the predetermined number of available bits to further improve the quality of the encoded audio bitstream. One embodiment of the present invention provides a scalefactor projection method. The method is used for determining N scalefactors (SF(I), I=1~N) required by an audio frame which is sampled from an audio signal and encoded according to a coding algorithm. The audio frame is divided into N frequency subbands; the Ith scalefactor of the N scalefactors corresponds to the Ith frequency subband of the N frequency subbands. Every frequency subband has a corresponding absolute threshold of hearing (ATH(I), I=1~N) and a corresponding psychoacoustic masking value (PM(I), I=1~N), where N and I are natural numbers thereof. Absolute threshold of hearing (ATH) means the minimum value of a stimulus that can be perceived by ordinary human ears.

The method of the embodiment includes the following steps: (a) Determine if the Ith Psychoacoustic Masking value (PM (I)) in the Ith frequency subband is smaller than the Ith Absolute Threshold of Hearing (ATH (I)), and if the result is YES, then sets the Ith scalefactor (SF (I)) to be zero. (b) Calculate N offsets (O (I), I=1~N) of each N frequency subbands. (c) Input the N psychoacoustic masking values (PM (I)), I=1~N) and the N offsets (O (I)), I=1~N) into a first projection formula respectively to generate N first projection values (FPV (I), I=1~N). (d) Determine if the Ith first projection value (FPV (I)) is smaller than a lower limit value (for instance, if it is smaller than zero.). (d–1) If YES in (d), then sets the Ith scalefactor(SF (I)) as the lower limit value (for instance, to be zero). (d–2) If NO in (d), then sets the Ith scalefactor (SF (I)) to be the Ith first projection value (FPV (I)).

The embodiment also provides a stepsize factor projection method. The method includes: (e) Input N offsets (O (I)), I=1~N) respectively to a second projection formula to generate a second projection value (SPV). (f) Set the stepsize factor to be the second projection value (SPV). (g) Proceed a determination loop iteratively to modify the stepsize factor until the request of the encoding algorithm is satisfied. By these means, the embodiment predicts the scalefactor of every frequency subband, so the simplification of the distortion controlled loop of the prior art is obtained. Furthermore, the embodiment accelerates the computing speed of the bit rate control loop of the prior art by determining the stepsize factor in advance. Through these two methods, the embodiment greatly improves the efficiency of the bit allocation process.

These and other objectives of the present invention will no doubt become obvious to those of skilled in the art after reading the following detailed description of the preferred embodiment, which is illustrated in various figures and drawings.

DETAILED DESCRIPTION OF THE PREFERRED EMBODIMENT

Figure 1:
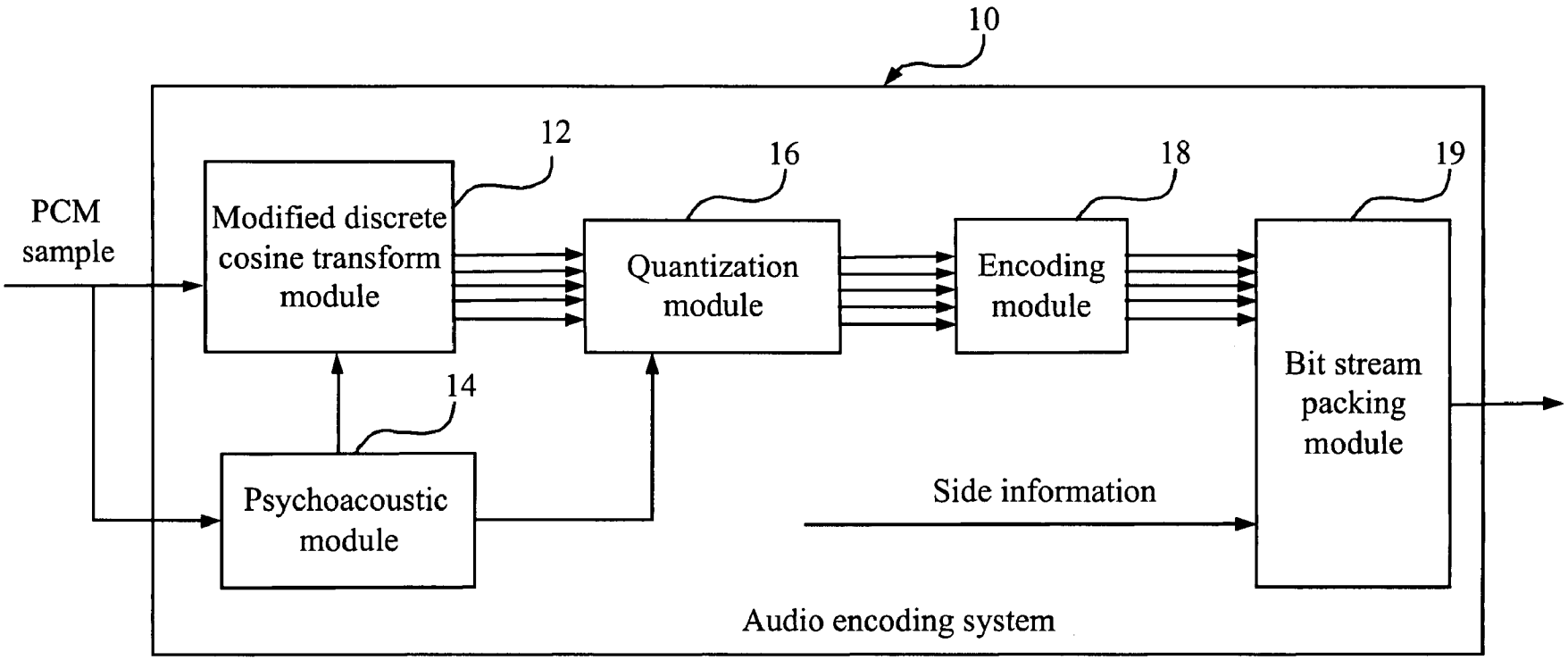
FIG. 1 shows a functional block diagram of an audio encoding system of the prior art.
Figure 2:
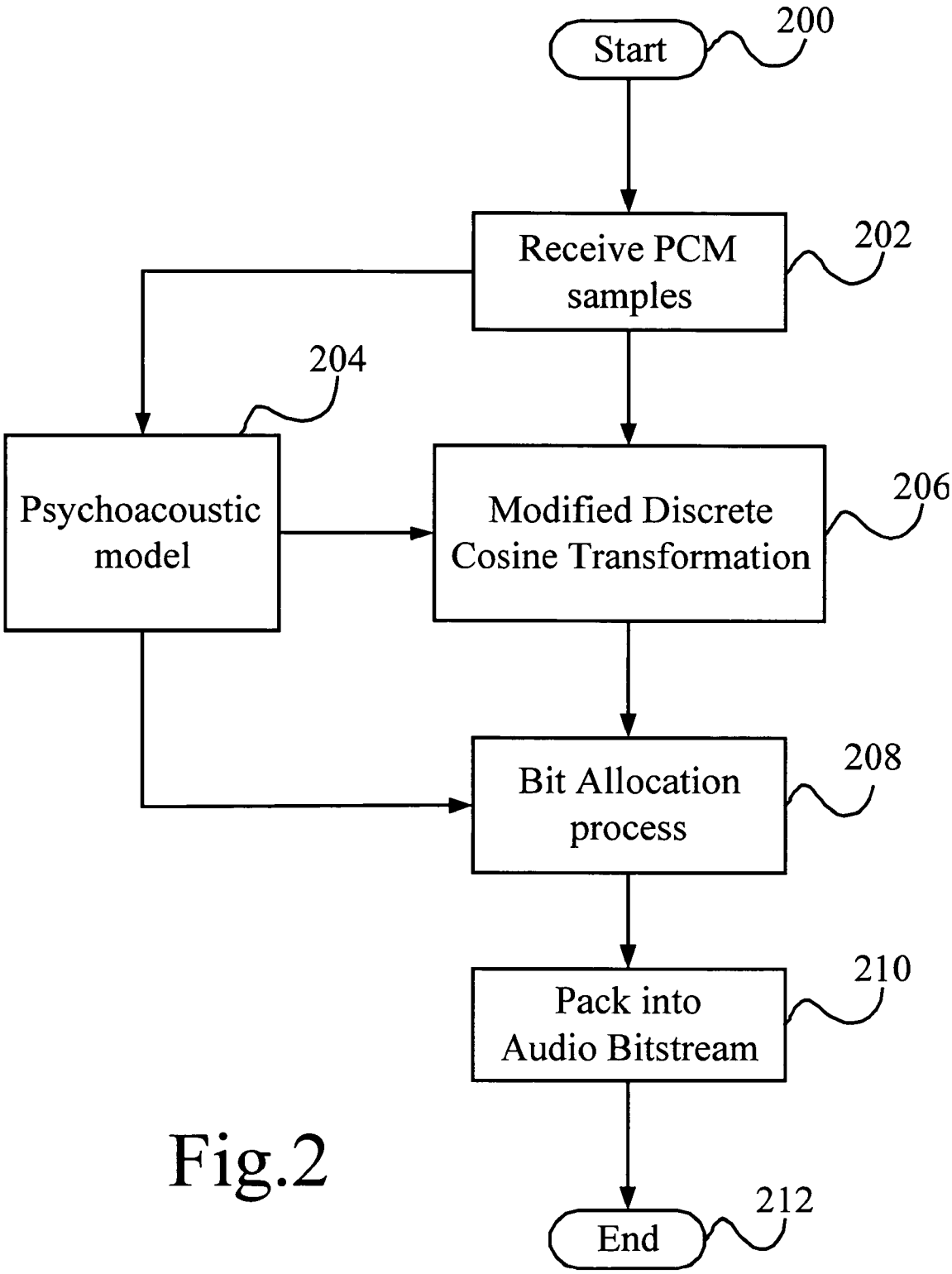
FIG. 2 shows the flow chart diagram of encoding logics of the prior art.
Figure 3:
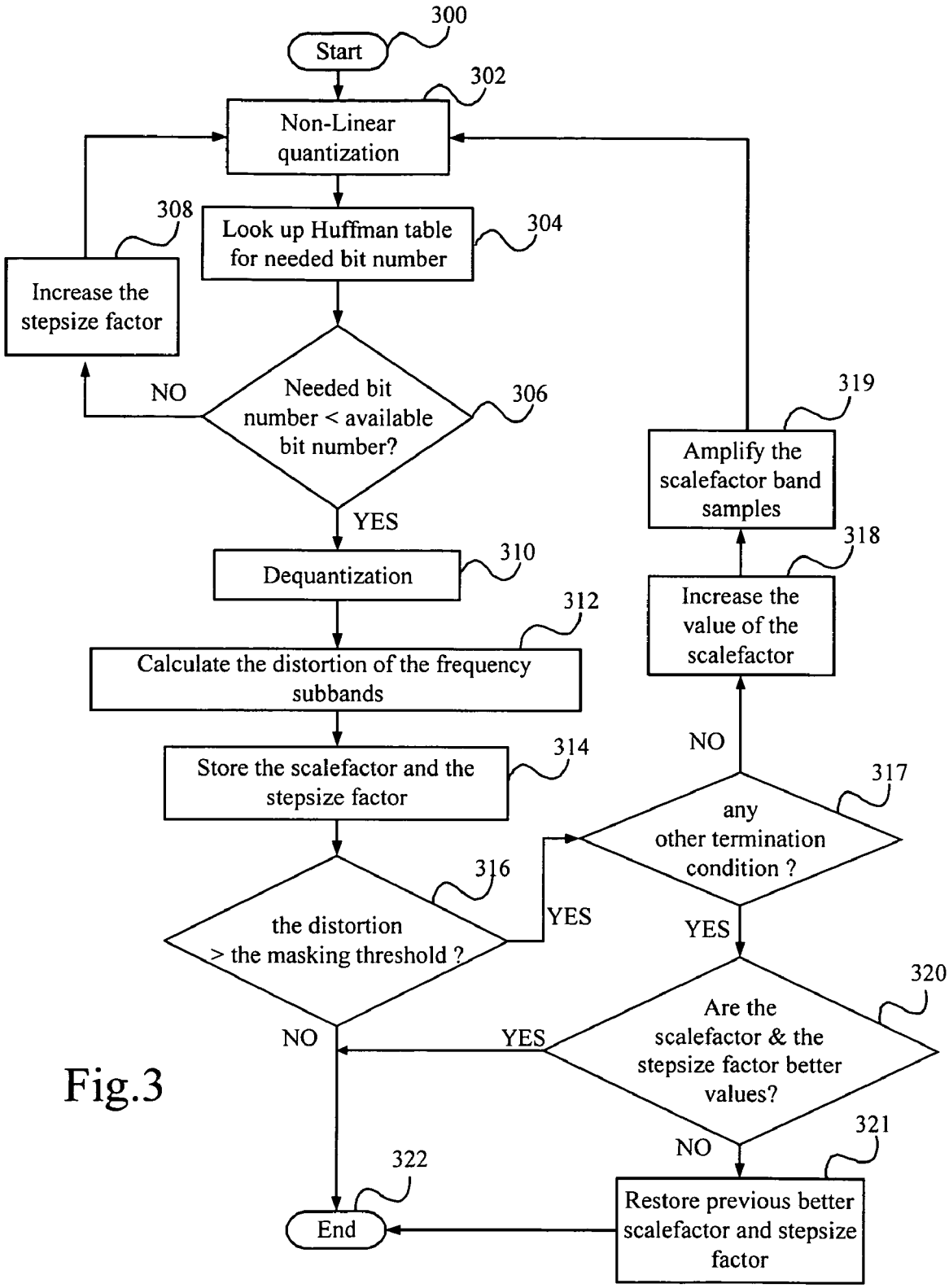
FIG. 3 shows a flow chart diagram of bit allocation procedure of the prior art.
Figure 4:
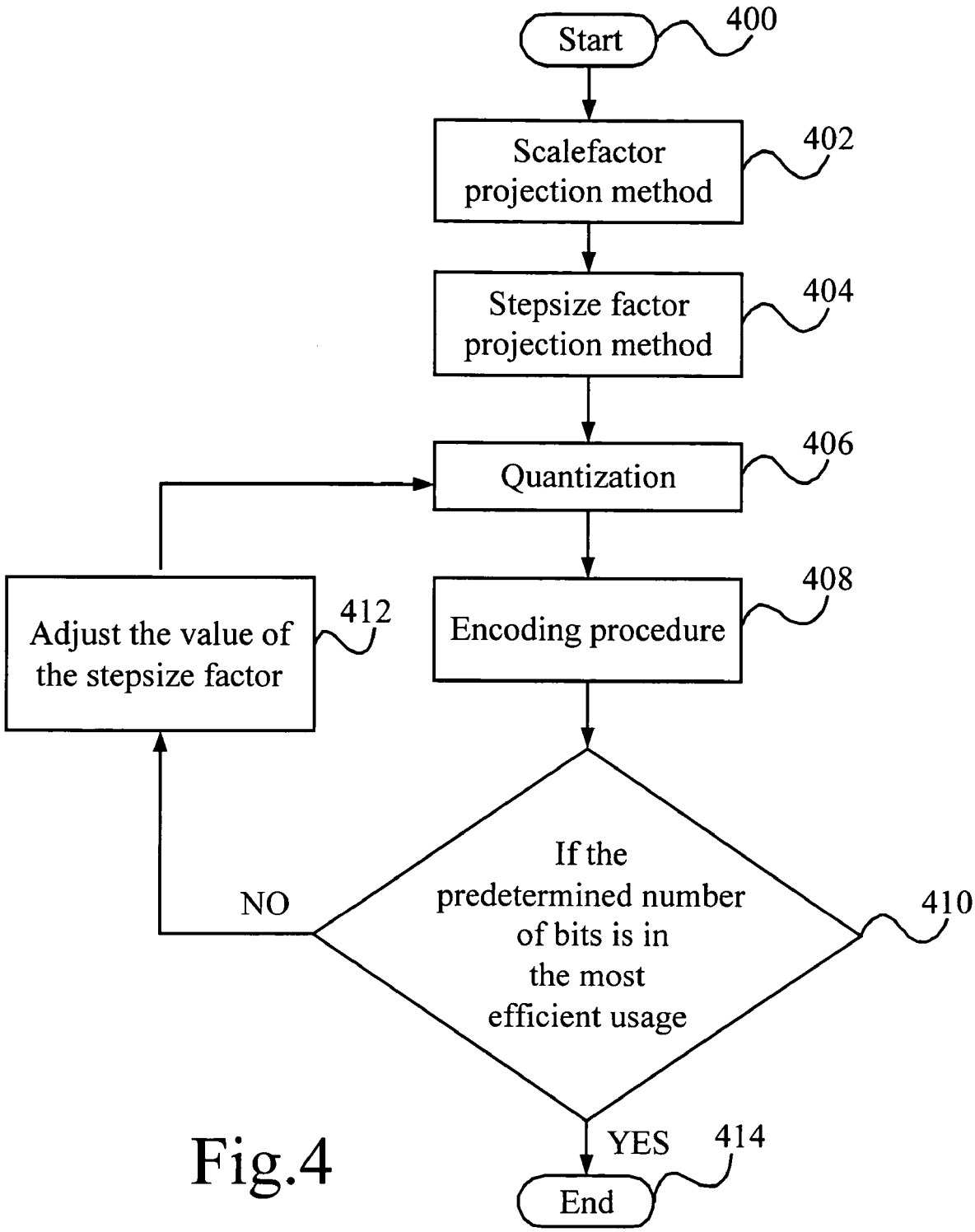
FIG. 4 shows the flow chart diagram of the bit allocation procedure according to one embodiment of the present invention.

Referring to FIG. 4, FIG. 4 illustrates the flow chart of the bit allocation procedure according to one embodiment of the present invention. The flow chart illustrates a bit allocation procedure for allocating available bits of a predetermined number of a plurality of frequency subbands in an audio frame. This is in order to determine the number of bits needed by every frequency subband of the audio frame under the limited predetermined number of available bits. The audio frame is sampled from an audio signal and is encoded according to an audio coding algorithm. The number of the frequency subbands in an audio frame varies with the adopted audio coding method. For instance, after employing a long window size performing the modified discrete cosine transformation,_the MPEG-audio LAYER-3 coding audio frame has twenty-two frequency subbands.

As described in the background of the invention, every frequency subband has been pre-processed by a psychoacoustic model and therefore has a corresponding psychoacoustic masking threshold, as well as an absolute threshold of hearing (ATH). What should be noted is the frequency subband described in this embodiment is composed by a plurality of MDCT samples, using the same scalefactor.

As show in FIG. 4, the bit allocation procedure of the embodiment includes the following steps:

STEP 400: Start.

STEP 402: Execute a scalefactor projection method so that every frequency subband can generate a corresponding scalefactor.

STEP 404: Execute a stepsize factor projection method so as to generate a predicted stepsize factor of an audio frame.

STEP 406: Quantize every frequency subband according to the predicted stepsize factor.

STEP 408: Encode every quantized frequency subband by means of an encoding method. The encoding method varies according to different audio encoding algorithms. For instance, the encoding method of MPEG-audio LAYER-3 encodes the quantized frequency subbands based on a predetermined Huffman table.

STEP 410: Determine if the predetermined number of bits is most efficiently used according to a determining criterion. If YES, then go to STEP 414. If NO, then go to STEP 412.

STEP 412: Adjust the value of the projection stepsize factor and go back to STEP 406.

STEP 414: End.

The determining criterion described in STEP 410 changes with different bit allocation procedure. The determining criterion of the prior art would be that the number of bits used each time is not allowed to exceed the predetermined number of available bits. The number of used bits is generally inversely proportional to the stepsize factor; therefore, it would gradually be closer to the predetermined number of available bits. If the number of used bits exceeds the predetermined amount, the stepsize factor used in the previous loop will be taken as the final stepsize factor.

In this embodiment, the restriction of the determining criterion is that the number of bits used by the frequency subband cannot be higher than the predetermined number of bits or lower than a lower limit value. And the adjusting method of the stepsize factor is that subtracting the effective number of bits from the number of bits used after the frequency subband has been quantized, then it is divided by a reference number, and thus obtains an adjusting value (the lower limit is +1 or −1) of the stepsize factor. In this embodiment, the reference number is 60.

In the second embodiment of the invention, the restriction of the determining criterion is that the quantized frequency subband should be able to undergo the Huffman encoding, meaning that the value after quantization is not allowed to exceed the upper limit recorded in the Huffman table. Under this restriction, the stepsize factor adjusting method is that subtracting the upper limit value recorded in the Huffman table from the maximum quantized value and dividing by a parameter to obtain the adjusting value (the lower limit is +1) of the stepsize factor. In this embodiment, the reference number is 240.

In the third embodiment of the present invention, the two restrictions described above and the corresponding methods of stepsize factor adjustment are combined to reach a better bit allocation result. It should be noted that the result after one loop calculation in the present invention is not only adding 1 to the stepsize factor but calculating and generating the adjusting value by the adjusting methods above. Moreover, the stepsize factor may not only be increased but can also be decreased. Therefore, comparing the prior arts with the present invention, the present invention can efficiently decrease the times of the loop calculation, steps in the loop calculation, and also make more efficient use of the predetermined number of available bits (the actual number of bits for encoding can be closest to the predetermined number of available bits).

To summarize the above illustrations, comparing with the prior art, the present invention avoids STEP 310 to STEP 322 in the bit allocation procedure of the prior art, meaning that it avoids the distortion control loop (or the outer loop). Therefore, the present invention simplifies the complicated bit allocation procedure of the prior art and provides a bit allocation procedure with fewer steps.

Figure 5A:
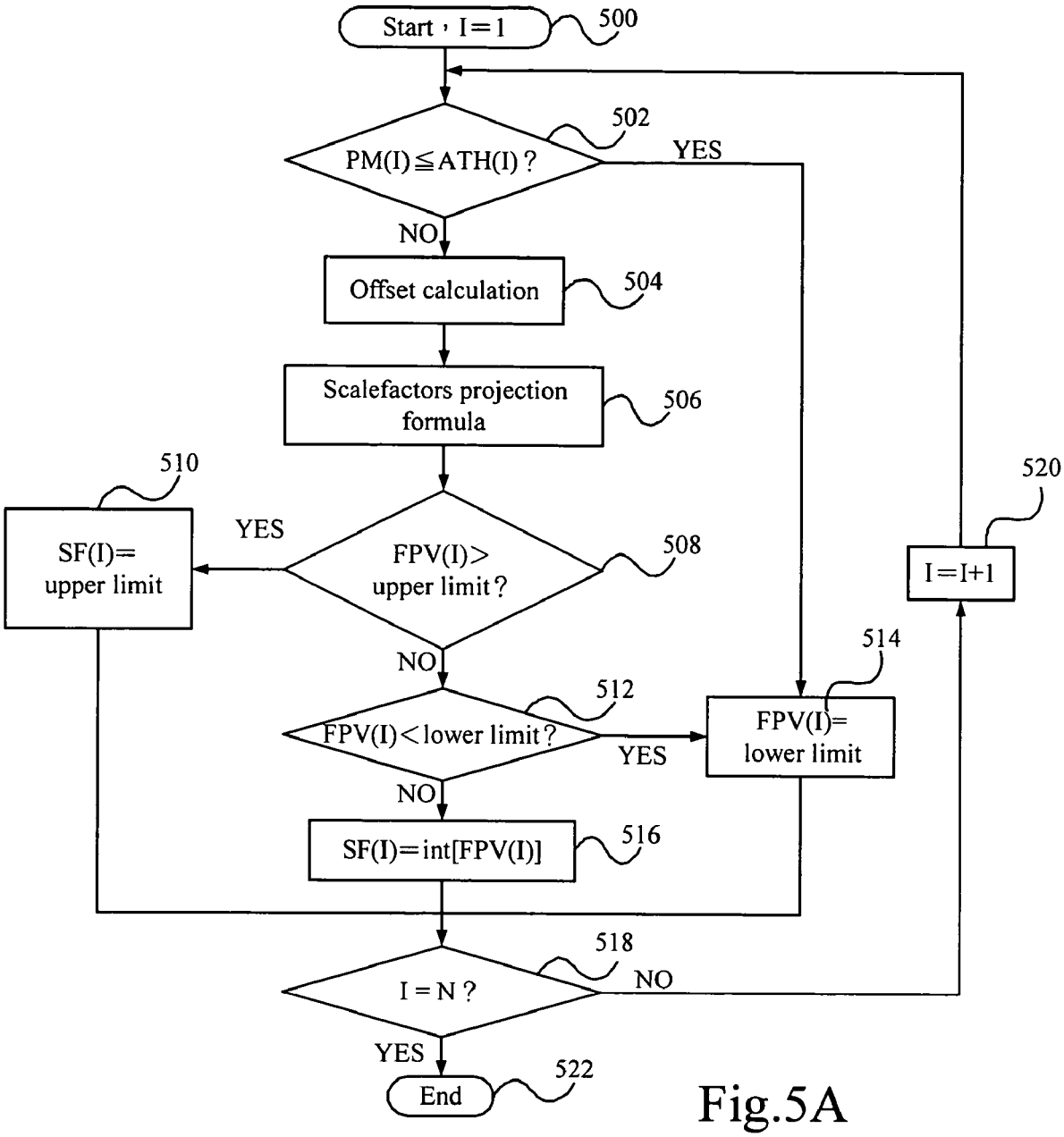
FIG. 5A shows the flow chart diagram of the projection method according to the embodiment of the present invention.

Referring to FIG. 5A, FIG. 5A shows the flow chart of the projection method according to one embodiment of the present invention. In order to explain the present scalefactor projection method, it is assumed that the audio frame described above is divided into N frequency subbands; therefore, an audio frame totally needs N scalefactors (SF(I), I=1~N). The Ith scalefactor in these N scalefactors corresponds to the Ith frequency subbands of the N scale subbands. There are one corresponding absolute threshold of hearing (ATH(I), I=1~N) and one psychoacoustic masking value (PM (I), I=1~N) for each frequency subband, wherein N and I are natural numbers.

The scalefactor projection method of the present invention comprises the following steps:

STEP 500: Start, I=1.

STEP 502: Determine if the Ith psychoacoustic masking value (PM(I)) is smaller than or equal to the Ith absolute threshold of hearing (ATH(I)). If YES, then go to STEP 514. If NO, then go to STEP 504.

STEP 504: Generate a corresponding offset (O(I), I=1~N) for the Ith frequency subband.

The corresponding offset can be obtained in various ways. For example, in one embodiment of the present invention, the Ith offset (O(I)) is generated according to the following formula:

$$O(I) = \frac{\sum_{I=1}^{N} -\log_2 PM(I)}{N}$$

In another embodiment of the present invention, the Ith offset (O(I)) is the function of the stepsize factor Q(t−1) and the logarithm LPM. Q(t−1) is the stepsize factor of the previous audio frame. LPM is the logarithm of the psychoacoustic value of each frequency subband in the that audio frame with base number 2 ($\log_2$PM(I)). That is, $$O(I)=f(Q(t-1),LPM), \text{ wherein } LPM=\log_2 PM$$

In the same sense, those skilled in the art may also use the parameters (e.g. Scalefactor) determined in the previous audio frame or other information in that audio frame (e.g. Predetermined number of bits, value of MDCT sample, etc.) to calculate the offset of the present invention.

STEP 506: Input the Ith psychoacoustic masking value (PM(I)) and the Ith offset (O(I), I=1~N) individually to a scalefactor projection formula to calculate the Ith scalefactor projection value (FPV(I)).

In one embodiment of the present invention, the Ith scalefactor projection value (FPV(I)) is generated from the following scalefactor projection formula:

$$FPV(I) = \frac{1}{2K} \times (-\log_2 PM(I) - O(I))$$

Wherein K is a constant, which will be 0.5 or 1 in MPEG Audio Layer 3 or 0.25 in AAC.

STEP 508: Determine if the Ith first projection value (FPV (I)) is higher than an upper limit. If YES, then go to STEP 510. If NO, then go to STEP 512.

STEP 510: Set the Ith scalefactor (SF(I)) to be that upper limit, and then go to STEP 518.

STEP 512: Determine if the Ith scalefactor (FPV(I)) is smaller than a lower limit (e.g. 0). If YES, then go to STEP 514. If NO, then go to STEP 516.

STEP 514: Set the Ith scalefactor (SF(I)) to be that lower limit (e.g. a value of zero), then go to STEP 518.

STEP 516: Set the Ith scalefactor (SF(I)) to be the integer part of the Ith scalefactor projection value (FPV(I)).

The "int" showed in this step in FIG. 5A represents the action to take the integer part and to give up the decimal figure of FPV(I), to take the integer part plus 1 and to give up the decimal figure of FPV(I), or to choose the integer which is closest to FPV(I). The action to take the integer part is in order to conform to the scalefactor requirements set forth in MPEG Audio Layer 3 or AAC standard. It is noted that if this embodiment is applied to other encoding standards, the action and step to take "int" may be omitted if no such requirement is set forth.

STEP 518: Determine if the variable "I" is equal to the constant "N". If No, then go to STEP 520. If YES, then go to STEP 522.

STEP 520: Process the next scalefactor projection, set I=I+1, then go to STEP 502.

STEP 522: End.

Figure 5B:
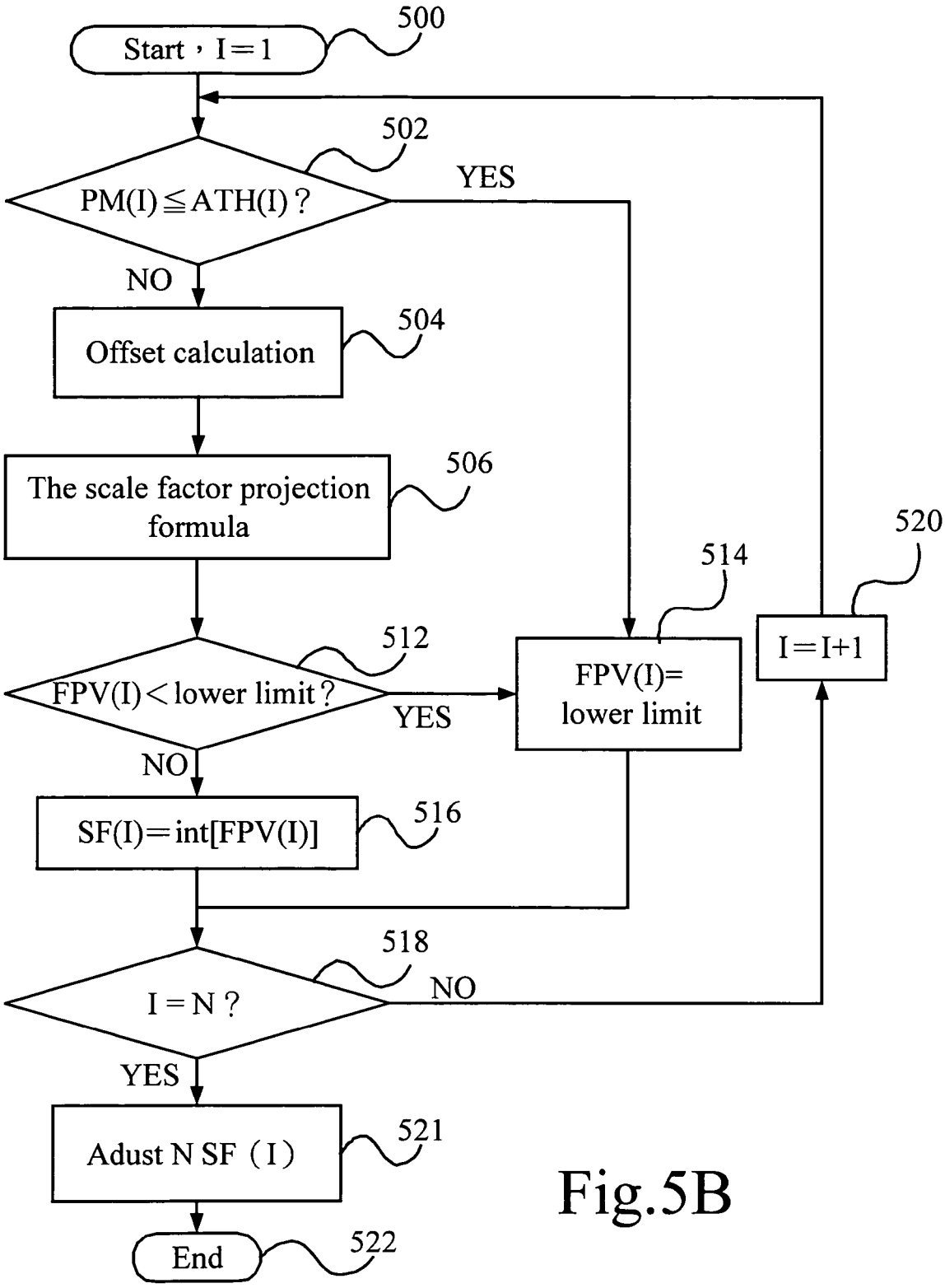
FIG. 5B shows the flow chart diagram of the projection method according a second embodiment of the present invention.

Referring to FIG. 5B, FIG. 5B shows the flow chart of another embodiment of the present invention. In this embodiment, STEP 508 and STEP 510 in FIG. 5A are omitted, and STEP 521 is added. The other steps remain the same as described in FIG. 5A, so no redundant description will be repeated here. The added STEP 521 in FIG. 5B is to adjust N scalefactors by means of the upper limit. In other words, when all of the N scalefactors' operations in STEP 518 are finished, if there are scalefactors exceeding the upper limit, then all the N scalefactors are shifted downward to let the maximum scalefactor equal to the upper limit, and scalefactors which are smaller or equal to the lower limit after the shift are adjusted to be equal to the lower limit. To sum up the descriptions above, the scalefactor projection method directly calculates the most suitable scalefactor for the frequency subband in a prediction or projection way, thus avoiding the replicated steps of calculation, as compared with the prior arts. It greatly improves the efficiency of the bit allocation procedure.

Figure 6:
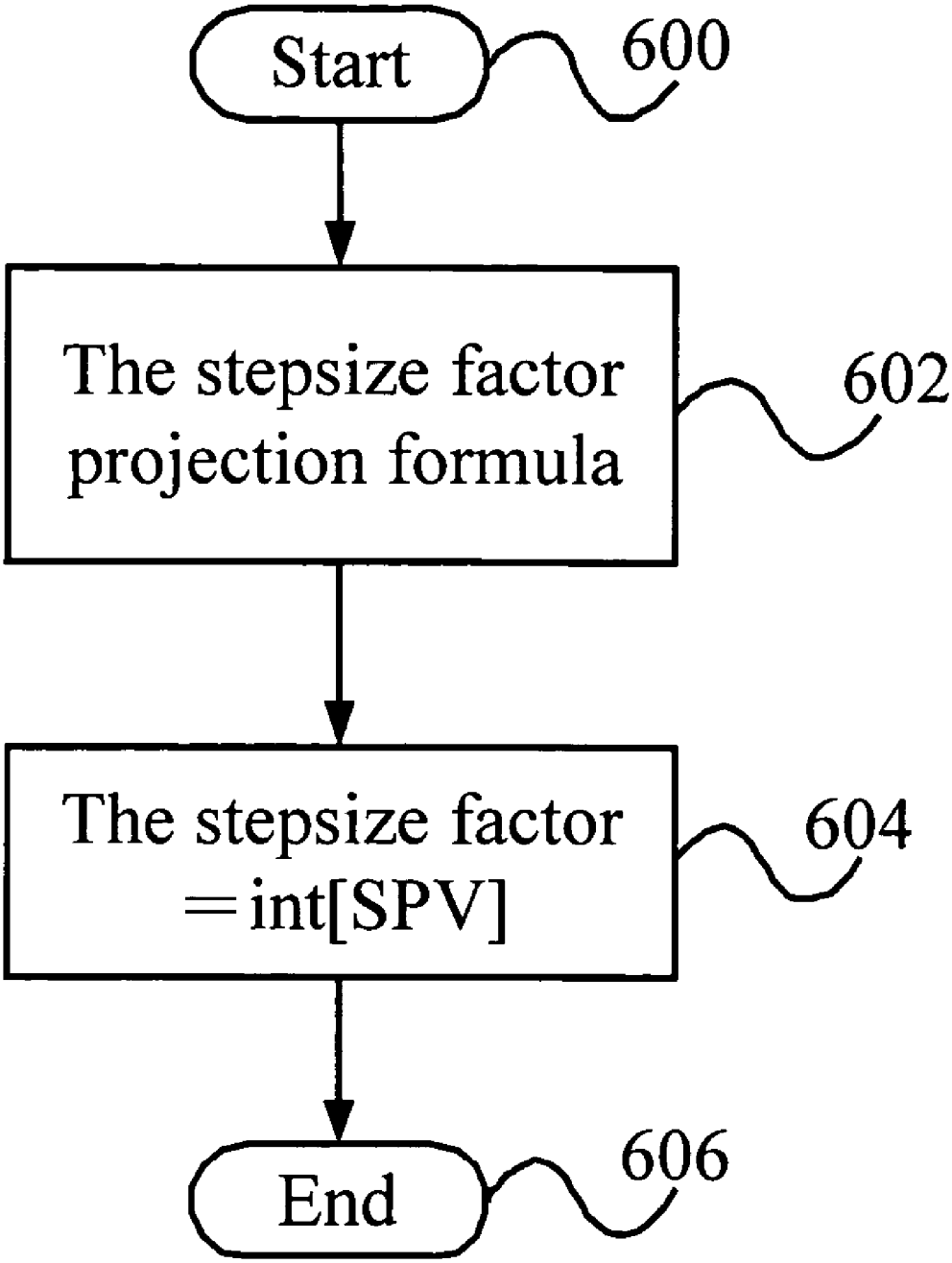
FIG. 6 shows the flow chart diagram of the stepsize factor projection method of one embodiment.

Referring to FIG. 6, FIG. 6 shows the flow chart of the stepsize factor projection method of the present invention:

STEP 600: Start.

STEP 602: Input the Ith offset (O(I)), I=1~N) into a stepsize factor projection formula to generate a stepsize factor projection value.

In one embodiment of the present invention, the stepsize factor projection value (SPV) can be generated from the following stepsize factor projection formula:

$$SPV=C-2\times E(O(I))$$

Wherein C is a constant (for example: a constant value of 6), E(O(I)) generates an expectation value of the N offset O(I)).

STEP 604: Let the projected stepsize factor equal to the integer part of the stepsize factor projection value. The "int" showed in FIG. 6 represents the operation to take the integer part and to give up the decimal figures, to take the integer part plus 1 and to give up the decimal figure of FPV(I), or to choose the integer which is closest to FPV(I). The action to take the integer part is in order to conform to the requirements of the stepsize factor in MPEG Audio Layer 3 or AAC standards. However, it should be noted that if this embodiment is applied to other encoding standards, the action and step to take "int" may be omitted if no such requirement is set forth.

STEP 606: End.

By means of the stepsize factor projection method, the present invention avoids the replicated calculation in the prior arts by setting a preferred stepsize factor in advance, and therefore greatly improves the efficiency of the bit allocation procedure.

Figure 7:
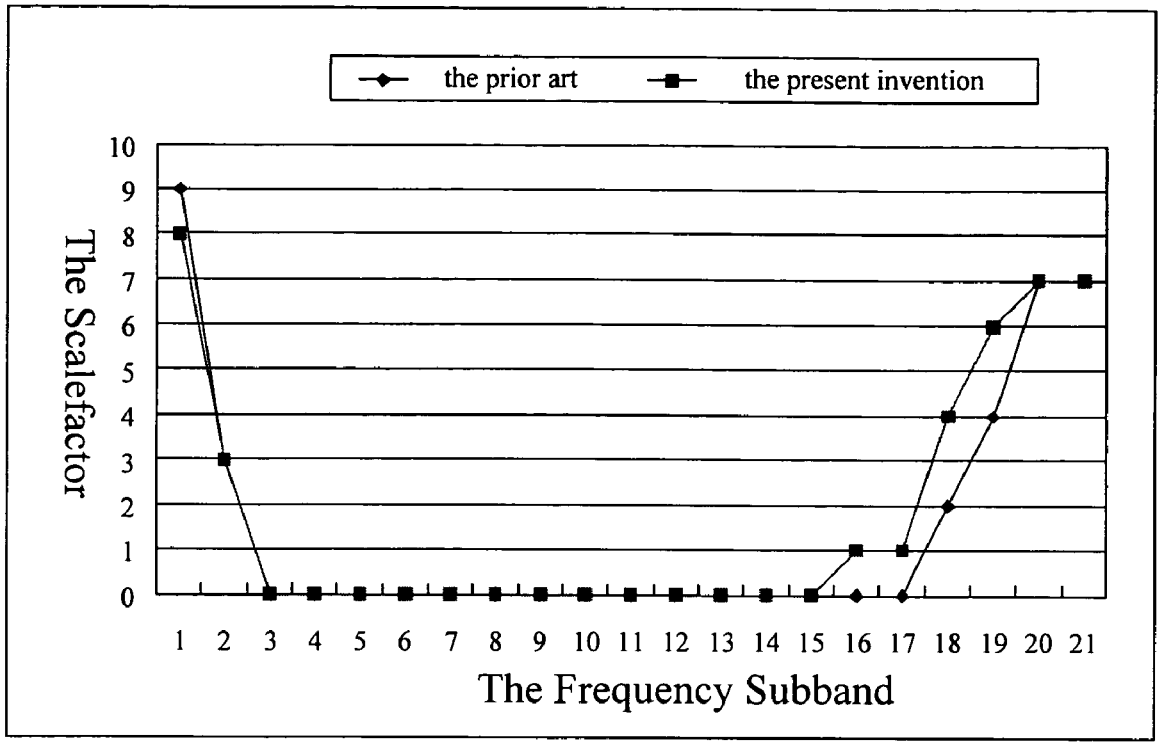
FIG. 7 shows the curve diagram of the frequency subband and the corresponding scalefactor.

Though the present invention simplifies the steps of the bit allocation procedure in the prior art, it doesn't descend the output audio quality. In the following, an experiment and the associated diagram are provided as a proof. Referring to FIG. 7, FIG. 7 shows the curve diagram of the frequency subband and the corresponding scalefactor. The data and the associated diagram in FIG. 7 are obtained by adopting the encoding algorithm of MPEG Audio Layer-3, wherein the sampling rate is 44.1 kHz, the bit rate is 128 kbps, and the offset is calculated according to the embodiment of the present invention $$\left(\text{e.g. } O(I) = \frac{\sum -\log_2 PM(I)}{N}\right).$$

The curve formed by the square data points in FIG. 7 represents the result of the bit allocation procedure of the prior art, and the curve formed by the diamond data points in FIG. 7 shows the result of the bit allocation procedure of the present invention. The diagram shows there is no obvious difference between the two curves, but concerning the simplification of the procedural steps and the efficiency of the process, the present invention is apparently more advantageous than the prior art.

To sum up the descriptions above, the present invention simplifies the distortion control loop of the prior art by predicting the scalefactors of each frequency subband in advance. Furthermore, the present invention accelerates the bit rate control loop calculation of the prior art by predetermining the stepsize factors. Through the two methods described above, the present invention, comparing to the audio encoding technique of the prior art, significantly improves the process efficiency of the bit allocation procedure. Besides, the present invention can properly adjust the stepsize factor value by an increment or decrement value. In comparison with the prior art, which can only increase the stepsize factor value, the present invention has a faster and better adjusting effect to further improve the efficiency of the bit allocation procedure.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An audio processing method in an audio encoding system, an audio frame comprising N frequency subbands, an Ith frequency subband among the N frequency subbands comprising M audio samples and having an Ith psychoacoustic masking value N and M being positive integers, I being an integer index ranging from l to N, the method comprising the following steps:

(a) calculating an Ith offset of the Ith frequency subband;

(b) inputting the Ith psychoacoustic masking value and the Ith offset into a first projection formula to generate an Ith first projection value;

(c) according to the Ith first projection value and a limit range, determining an Ith scale factor;

(d) according to the Ith scale factor, adjusting the M audio samples in the Ith frequency subband; and (e) generating an audio stream based on the adjusted audio samples.

2. The method of claim 1, wherein step (c) comprises:

(c') determining if the Ith first projection value is smaller than a lower limit of the limit range;

(c'-1) if YES in step (c'), determining the Ith scale factor as equal to the lower limit; and (c'-2) if NO in step (c'), determining the Ith scale factor as equal to the Ith first projection value.

3. The method of claim 1, wherein the Ith frequency subband has an Ith absolute threshold of hearing, and before step (a), the method further comprising the steps of:

(a') determining if the Ith psychoacoustic masking value is smaller than or equal to the Ith absolute threshold of hearing;

(a'-1) if YES in step (a'), determining the Ith scale factor equal to a lower limit of the limit range; and (a'-2) if NO in step (a'), performing step (a).

4. The method of claim 1, wherein step (c) comprises:

(b-1) determining if the Ith first projection value is larger than an upper limit of the limit range; and (b-2) if YES in (b-1), determining the Ith scale factor as equal to the upper limit.

5. The method of claim 1, further comprising the step of:

adjusting the N scale factors based on an upper limit of the limit range.

6. The method of claim 1, wherein the first projection formula is:

$$FPV(I) = \frac{1}{2K} \times \left[-\log_2 PM(I) - O(I)\right]$$

where K is a first constant.

7. The method of claim 6, further comprising a step-size factor projection method, comprising the steps of:

inputting the N offsets into a second projection formula to generate a second projection value;

setting a step-size factor equal to the integer value of the second projection value; and performing a determining loop repeatedly to adjust the step-size factor.

8. The method of claim 7, wherein the second projection formula is:

$$SPV = \text{int}[C - 2 \times E(O(I))],$$

where C is a second constant, and E(O(I)) is an expected value of the N offsets.

9. The method of claim 8, wherein the Ith offset is generated from the formula:

$$O(I) = \frac{\sum -\log_2 PM(I)}{N}$$

10. The method of claim 8, wherein the N offsets are generated from a determined parameter relative to a former frame.

11. An audio processing method, an audio frame comprising N frequency subbands, an Ith frequency subband among the N frequency subbands comprising M audio samples, N and M being positive integers, I being an integer index ranging from l to N, the procedure comprising:

performing a scale factor projection method to generate an Ith scale factor corresponding to the Ith frequency subband;

according to the Ith scale factor, adjusting the M audio samples in the Ith frequency subband to generate M adjusted audio samples corresponding to the Ith frequency subband;

performing a step-size factor projection method to generate a step-size factor corresponding to the audio frame;

according to the step-size factor, quantizing the M adjusted audio samples corresponding to the Ith frequency subband to generate M sets of quantized data;

encoding the M sets of quantized data corresponding to the Ith frequency subband with an encoding method;

according to a determination criterion, determining whether a predetermined number of bits corresponding to the audio frame is well employed after the quantizing and encoding steps, if NO, adjusting the step-size factor according to a step-size factor adjusting method and re-performing the quantizing and encoding steps, if YES, generating an audio stream based on the encoded data.

12. The procedure of claim 11, wherein the step-size factor projection method comprises the following steps:

respectively generating an offset for each of the N frequency subbands;

inputting the offsets into a second projection formula to generate a second projection value; and assigning the step-size factor as equal to the integral value of the second projection value.

13. The procedure of claim 12, wherein the second projection formula is the function of the offsets.

14. The procedure of claim 13, wherein the audio frame is corresponding to a former audio frame, and the offsets are generated based on parameters relative to the former audio frame.

15. The procedure of claim 11, wherein the Ith frequency subband is corresponding to an Ith absolute threshold of hearing and an Ith psychoacoustic masking value.

16. The procedure of claim 15, wherein the scale factor projection method comprises the following steps:

(a) generating an Ith offset for the Ith frequency subband;

(b) inputting the Ith psychoacoustic masking value and the Ith offset into a first projection formula to generate an Ith first projection value; and (c) according to the Ith first projection value and a limit range, determining the Ith scale factor.

17. The procedure of claim 16, wherein step (c) comprises:

(c') determining if the Ith first projection value is smaller than a lower limit of the limit range;

(c'-1) if YES in (c'), determining the Ith scale factor as equal to the lower limit; and (c'-2) if NO in (c'), determining the Ith scale factor as equal to the first projection value.

18. The procedure of claim 16, before step (a), the method further comprising:

(a') determining if the Ith psychoacoustic masking value is smaller than the Ith absolute threshold of hearing;

(a'-1) if YES in (a'), assigning the Ith scale factor as equal to a lower limit of the limit range; and (a'-2) if NO in (a'), performing step (a).

19. The procedure of claim 16, wherein step (c) comprises:

(b-1) determining if the Ith first projection value is higher than an upper limit of the limit range; and (b-2) if YES in step (b-1), assigning the Ith scale factor as equal to the upper limit.

20. The procedure of claim 16, wherein the scale factor projection method further comprises:

(d) adjusting the scale factors according to an upper limit of the limit range.

21. The procedure of claim 16, wherein the first projection formula is the function of the Ith psychoacoustic masking value and the Ith offset.

22. The procedure of claim 21, wherein the audio frame is corresponding to a former audio frame, and the Ith offset is generated based on parameters relative to the former audio frame.

* * * * *